US006454094B1

(12) United States Patent
Salani

(10) Patent No.: US 6,454,094 B1
(45) Date of Patent: Sep. 24, 2002

(54) ROTATABLE LABEL SYSTEM

(76) Inventor: Lawrence Aldo Salani, 604 Geri Ct., Palatine, IL (US) 60067

( * ) Notice: Subject to any disclaimer, the term of this patent is extended or adjusted under 35 U.S.C. 154(b) by 0 days.

(21) Appl. No.: 09/460,554

(22) Filed: Dec. 14, 1999

(51) Int. Cl.[7] ..... G09F 11/02

(52) U.S. Cl. ..... 206/459.1; 40/310; 40/506; 206/534

(58) Field of Search ..... 206/446, 459.1, 206/459.5, 534; 40/310, 312, 493, 506

(56) References Cited

U.S. PATENT DOCUMENTS

| | | | | | |
|---|---|---|---|---|---|
| 2,013,616 | A | * | 9/1935 | Rettenmeyer | 40/306 |
| 2,115,494 | A | * | 4/1938 | Lurssen | 206/446 |
| 2,325,224 | A | * | 7/1943 | Bryant, Sr. | 206/446 |
| 2,860,431 | A | * | 11/1958 | Barnum, Jr. | 40/306 |
| 2,935,814 | A | * | 5/1960 | Freeze | 40/503 |
| 3,006,461 | A | * | 10/1961 | McGinnis | 206/446 |
| 3,397,772 | A | * | 8/1968 | Farquhar | 206/446 |
| 4,170,295 | A | * | 10/1979 | Kuehl et al. | 206/429 |
| D311,423 | S | | 10/1990 | DeSantis | |
| 5,551,582 | A | | 9/1996 | Robinson | |
| 5,809,674 | A | * | 9/1998 | Key | 40/306 |
| 5,816,428 | A | | 10/1998 | Plester | |
| 5,860,526 | A | | 1/1999 | Burke, Jr. | |
| 5,884,421 | A | | 3/1999 | Key | |
| 6,086,697 | A | * | 7/2000 | Key | 40/306 |
| 6,129,802 | A | * | 10/2000 | Key | 40/306 |

FOREIGN PATENT DOCUMENTS

| | | |
|---|---|---|
| WO | WO 97/40724 | 11/1997 |
| WO | WO 98/18617 | 5/1998 |
| WO | WO 98/19288 | 5/1998 |
| WO | WO 98/19289 | 5/1998 |
| WO | WO 98/43226 | 10/1998 |

* cited by examiner

*Primary Examiner*—Jim Foster
(74) *Attorney, Agent, or Firm*—Katten Muchin Zavis Rosenman

(57) ABSTRACT

A rotatable label system includes a label and a package with a viewing window that is secured to the container but which allows access to the container and also allows the container to freely rotate relative to the package. The package is configured with a different form factor than the container itself to provide an interstice adjacent the viewing window. The interstice allows consumers to view contiguous portions of the label on the container that are not aligned with the viewing window. As such, consumers are able to easily recognize that the label system is rotatable.

14 Claims, 2 Drawing Sheets

ROTATABLE LABEL SYSTEM

BACKGROUND OF THE INVENTION

1. Field of the Invention

The present invention relates to a rotatable label system for use with different types of containers, for example pharmaceutical containers, which enables relatively more information to be provided to the consumer about the product, configured in such a way that the rotatable feature is easily recognized by consumers.

2. Description of the Prior Art

There is an ever increasing trend to increase the amount of information provided on labels for various containers. This is particularly true for containers which contain pharmaceutical products and various health food products. For example, U.S. Pat. No. D311,423 discloses a dual faced container label. The dual faced container label disclosed in the '423 patent is adapted to the disposed on a generally cylindrical container and configured in a way so that the main product information is viewable on diametrically opposite portions of the container. Unfortunately, the amount of information that can be placed on such a label is limited to the outside surface area of the label. As such, dual sided labels have been developed which contain product information on both sides of the label. There are several problems with such dual sided labels. First, such labels can only be used with products that are generally transparent. Moreover, depending upon the properties of the product within the container, the product information may be somewhat difficult to read thus discouraging consumers from reading the product information on the inside portion of the label.

In order solve these problems. Rotatable label systems have been developed. An example of the rotatable label system is disclosed in U.S. Pat. No. 5,884,421. The '421 patent discloses a rotatable label system which includes an inner shell, fixed to the container, and a rotatable outer shell. The rotatable outer shell is provided with a viewing window and is generally configured to have a slightly larger diameter than the diameter of the inner shell. Such a label system is substantially the same size and shape of the container itself and thus has the same form factor as the container. The inner shell is provided with opposing radial rims which serve to limit axial movement of the outer shell with respect to the inner shell. The outer shell is provided with a viewing window for viewing product information which can be printed on the entire outer circumference of the inner shell. In addition, such a system lends itself to printing product information on the outer shell as well.

In operation, consumers simply read the product information through the viewing window and twist the outer shell to review additional information. Although such a rotatable label system enables substantially more product information to be placed on the label than fixed label systems, it is believed that many consumers do not realize that the label system is rotatable due to the form factor of a label system, substantially conforming to the form factor of the container itself. Thus, there is a need for providing a rotatable label system for providing relatively more information about the product than fixed label systems that also enables consumers to easily recognize that the label system is rotatable.

SUMMARY OF THE INVENTION

Briefly, the present invention relates to a rotatable label system. The label system includes a label which provides a surface for product information about its entire circumference. The rotatable label system also includes a package with a viewing window. The package is secured to the container but allows access to the container and also allows the container to freely rotate relative to the package. An important aspect of the invention is that the package is configured with a different form factor than the container itself In particular, the package in configured with an interstice adjacent the viewing window. The interstice allows consumers to view contiguous portions of the label on the container that are not aligned with the viewing window. As such, consumers are able to easily recognize that the label system is rotatable.

DESCRIPTION OF THE DRAWINGS

These and other advantages of the present invention will be readily understood with reference to the follow specification and attach drawings wherein.

DETAILED DESCRIPTION OF THE INVENTION

The present invention relates to a packaging design for use with different types of containers, for example, pharmaceutical containers, which enables relatively more information about the product in the container to be provided to the consumer relative to containers with fixed label systems. The system in accordance with the present invention includes a label which may be affixed or printed on the container and a package with a viewing window. The package is configured to. capture the container yet allow access to the contents of the container and also enable the container to rotate relative to the package.

An important aspect of the invention, is that the package is configured with a different form factor (i.e. size and/or shape) than the container. In particular, the package is configured to form an interstice adjacent the viewing window relative to the container. As such, information on the label contiguous to the portion of the label aligned with the viewing window can be seen by the consumer. Such a configuration enables consumers to easily recognize that the label system is rotatable.

Figure 5:
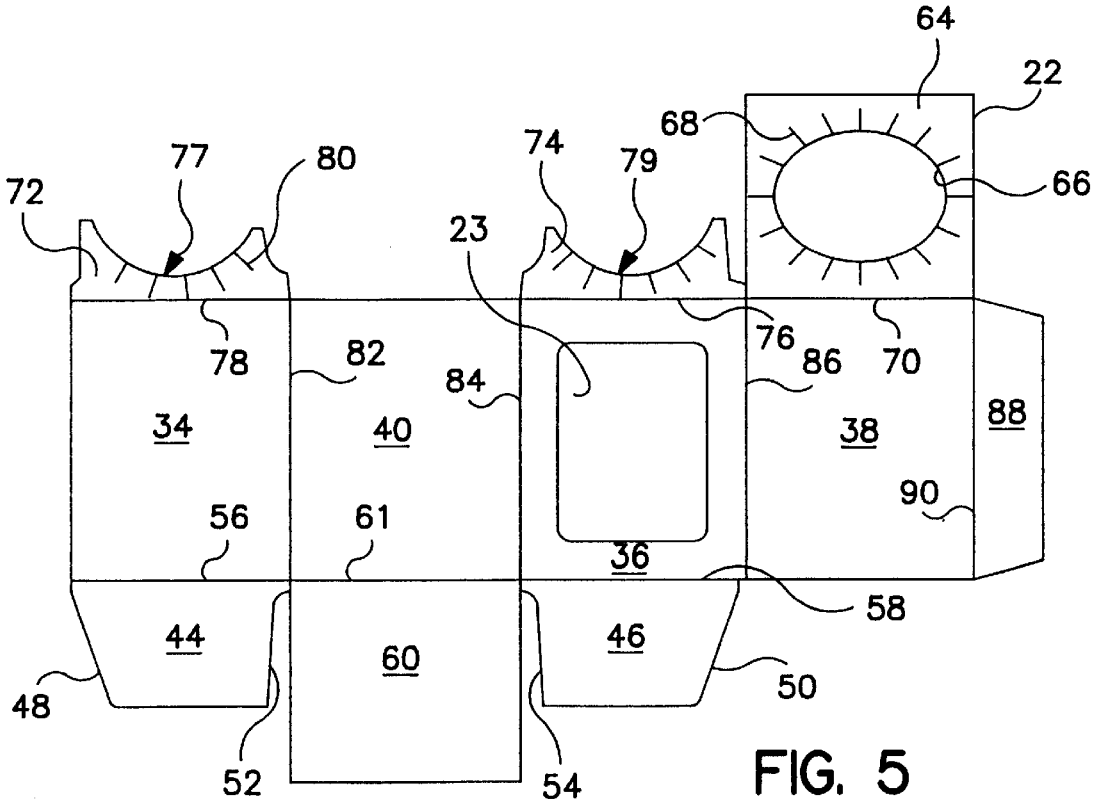
FIG. 5 is plan view of the die cut unglued package in accordance with the present invention
Figure 6:
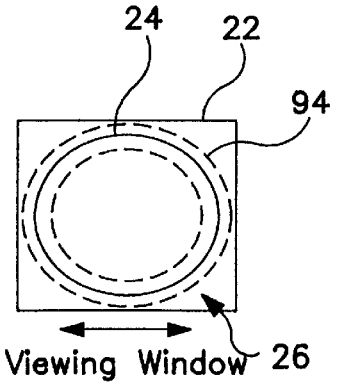
FIG. 6 is a plan view of the rotatable label system, illustrated in FIGS. 1–5.
Figure 7:
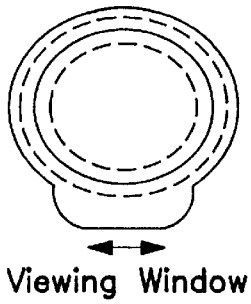
FIG. 7 is a plan view of an alternative embodiment of the rotatable label system illustrated in FIGS. 1–6, illustrating a cylindrical container and an irregular shaped package.
Figure 8:
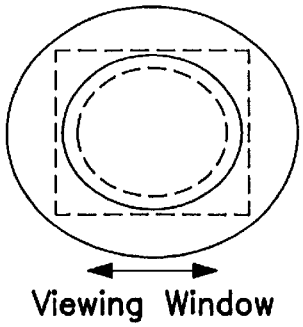
FIG. 8 is a plan view of an alternative embodiment of the rotatable label system illustrated in FIGS. 1–6, illustrating a generally square or rectangular container and a generally circular package.
Figure 9:
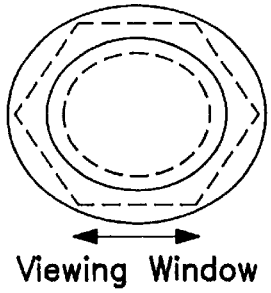
FIG. 9 is a plan view of an alternative embodiment of the rotatable label system illustrated in FIGS. 1–6, illustrating a generally hexagonal container and a generally circular package.
Figure 10:
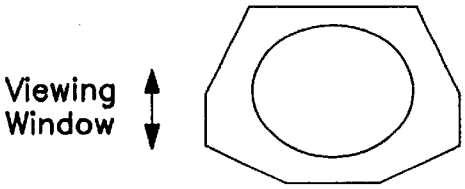
FIG. 10 is a plan view of an alternative embodiment of the rotatable label system illustrated in FIGS. 1–6, illustrating a generally circular container and a generally hexagonal package.
Figure 11:
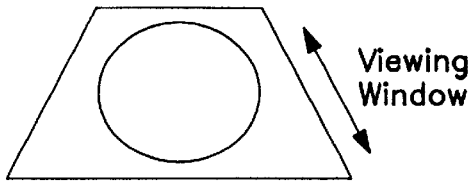
FIG. 11 is a plan view of an alternative embodiment of the rotatable label system illustrated in FIGS. 1–6, illustrating a generally circular container and a trapezoidal package.
Figure 12:
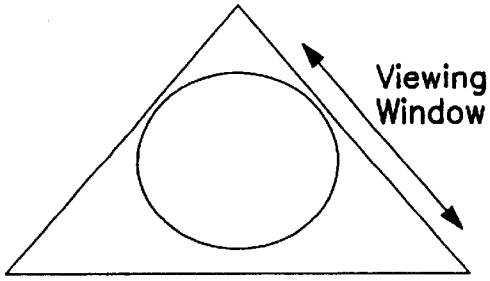
FIG. 12 is a plan view of an alternative embodiment of the rotatable label system illustrated in FIGS. 1–6, illustrating a generally circular container and a generally triangular package.
Figure 13:
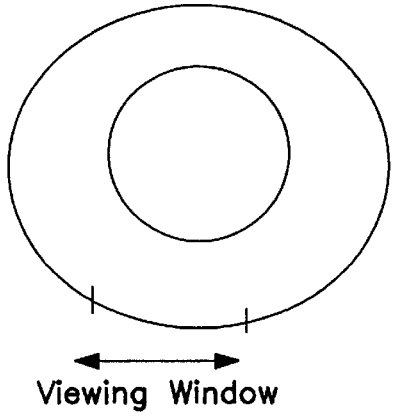
FIG. 13 is a plan view of a n alternative embodiment of the rotatable label system illustrated in FIGS. 1–6, illustrating a generally circular container and a relatively larger generally circular package.

Although the principles of the present invention are described and illustrated having a generally rectangular package, as generally illustrated in FIGS. 1–6, virtually any container configured such that an interstice is formed between the package and the container adjacent the viewing window is within the broad principles of the present invention. For example, for a generally cylindrical container, virtually any regular or irregular polygonal shaped package will form an interstice relative to the container adjacent the viewing window, such as triangular, hexagonal shaped packages, for example, as shown in FIGS. 10–12. The principles of the present invention are also applicable to non-polygonal shaped packages, such as cylindrical being relatively larger in diameter than the diameter of the container, for example, as shown in FIG. 13. Also, the principles of the present invention are also applicable to irregular shaped containers, configured to form an interstice relative to the container adjacent the viewing window, for example, as shown in FIG. 7. In addition, the principles of the present invention are also applicable with different shaped containers, such as polygonal shaped containers and virtually any shape container, for example, as shown in FIGS. 8 and 9, which, when combined with the package forms an interstice adjacent the viewing window on the package.

An exemplary embodiment of the rotatable packaging system in accordance with the present invention is illustrated in FIGS. 1–6 and generally identified with the reference numeral 20. The rotatable label system 20 includes a label (not shown) and a package 22 for rotatably housing a, for example, generally cylindrical container 24. The label may be a separate label, affixed to the container, or may be screen printed directly on the container 24.

Figure 1:
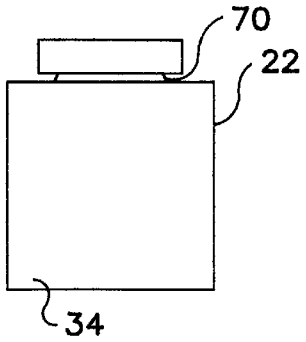
FIG. 1 is a front elevational view of a rotatable label system in accordance with the present invention.
Figure 2:
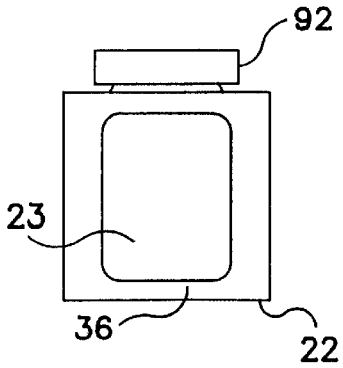
FIG. 2 is a back elevational view of the rotatable label system in accordance with the present invention illustrating the viewing window in the package.
Figure 3:
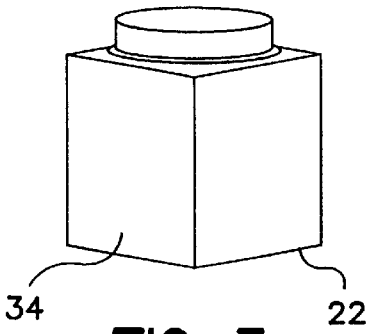
FIG. 3 is a perspective view of the packaging design illustrating the front and right side views of the rotatable label system in accordance with the present invention.
Figure 4:
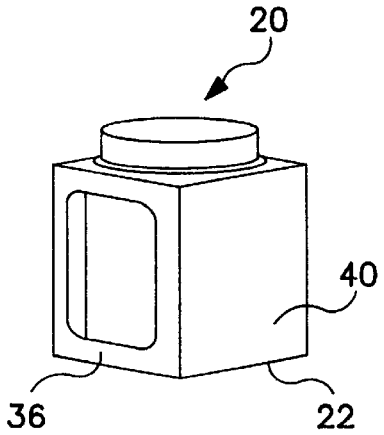
FIG. 4 is a perspective view of the packaging design illustrating the back and left side views of the rotatable label system in accordance with the present invention.

The package is formed with a different form factor than the container itself. As best shown in FIGS. 2 and 4, the viewing window 23 enables the contents of the label to be viewed outside the package 23. An important aspect of the invention relates to the configuration in which the form factor for the package 22 is different from the form factor of the package 22, thus forming an interstitial area adjacent the viewing window 23, for example, the interstitial area 26 (FIG. 6) between the outer surface of the container 24 and the inner surface of the package 22. As shown in FIG. 6, this interstitial area 26 is generally formed adjacent the viewing window 23 which enables additional product information on the label to be viewed by the consumer even though it is not aligned with the viewing window to enable the consumers to easily recognize that the label contains additional information other than what is aligned with the viewing window. As such, the system entices consumers to rotate the container 24 within the package 22.

FIGS. 1–6 illustrate how an exemplary system is fabricated. A plan view of the die cut of an unassembled package 22 is illustrated in FIG. 5. The package 22 is amenable to be formed from any packaging material and die cut by conventional techniques. As shown, the unassembled package includes a front vertical panel 34, a rear vertical panel 36, a right vertical side panel 38 and a left vertical side panel 40. The viewing window 23 is formed in the rear vertical panel 36. The various panels and flaps are coupled together at fold lines as discussed below. The fold lines are conventionally formed by die cuts and form hinges between the various panels and flaps.

A pair of bottom glue flaps 44 and 46 may be formed adjacent the front panel 34 and rear panel 36, respectively. These glue flaps 44 and 46 may be formed with angled outer surfaces 48 and 50 and notched inner surfaces 52 and 54 as shown to facilitate assembly of the container 22. The glue flaps 44 and 46 are attached to the front and rear panels 34 and 36 at a pair of fold lines 56 and 58. A closure flap 60 is disposed adjacent the left side 40 at a fold line 61. The glue flaps 44 and 46 may be secured to each other by way of a suitable adhesive and form a glue surface for the closure flap 60. The glue flaps 44 and 46 as well as the closure flap 60 capture the bottom end of the container 24 to prevent downward axial movement of the container 24 while allowing the container 24 and the package 22 to be fully rotatable with respect to each other.

A top flap 64 is formed with a generally circular aperture 66 and a plurality of radial perforations 68. The central aperture 66 as well as the radial perforations 68 allow a neck 70 (FIG. 1) of the container 22 to be slipped therethrough, thereby capturing the top part of the container 24, while still allowing the container 24 rotate relative to the package 22. The top flap 64 is formed adjacent the right side vertical flap 38 at a fold line 70.

A pair of collar flaps 72 and 74 are formed adjacent the rear vertical panel 40 and front vertical panel 34, respectively at a pair of fold lines 76 and 78. These collar flaps 72 and 74 are formed with generally circular portions 77 and 79 having a radius of a curvature selected to be slightly larger than the diameter neck 70 of the container 24. The collar flaps 72 and 74 may be provided with radial perforations 80 in order to facilitate assembly of the package 24.

The vertical panels 34, 36, 38 and 40 are joined together at vertical fold lines 82, 84 and 86. Disposed adjacent the right side panel 38 is a glue panel 88. The glue panel 88 is adapted to be secured to the interior of the front vertical panel 34. The glue panel 88 is secured to the right side vertical panel 38 at a fold line 90.

The package 22 is assembled by folding along the fold lines 82, 84, 86 and 90 to form a generally rectangular box. An adhesive may then either be applied to the glue panel 88 or the along the edge of the interior of the vertical panel 34. The glue panel 88 is then assembled to the vertical panel 34 to form a generally rectangular cross section. The bottom glue panels 44 and 46 are then folded along their fold lines 56 and 58 toward the interior of the generally rectangular box shape. These glue panels 44 and 46 may be secured together with a suitable adhesive. Subsequently, the closure panel 60 is folded along the fold line 61 and secured to the glue panels 44 and 46 with a suitable adhesive closing the bottom portion of the package 22.

Subsequently, a container may be disposed in the open top of the package 22 with its cap 92 (FIG. 2) removed. The collar panels 72 and 74 are folded along their fold lines 78 and 76 and may be used to form a gluing surface for the top closure panel 64. The top closure panel 64 is then folded along its fold line 70 and secured with a suitable adhesive to the collar panel 72 and 74. Once assembled the top closure panel 64 captures an annular shoulder 94 (FIG. 6) of the container 24 axial movement toward the top of the container 24 is prevented. The radial perforations 68 and 80 facilitate placement of the collar flaps 72 and 74 as well as the closure flap 64 around the neck 70 of the container 24. Subsequently, the container cap 92 is screwed in place and the package with the container 24 inside is ready for shipment.

Alternatively, the package 22 can be assembled in the same manner, except that the top closure panel 64 is closed first while the bottom glue flaps 44 and 46 and bottom closure flaps 60 are open. In this embodiment, the container cap 92 is removed from the container 22 and the container is fed in through the bottom of the package so that the neck 70 of the container 22 protrudes through the central aperture 66 in the top closure flap 64. At this point, the bottom glue flaps 44 and 46 as well as the bottom closure flaps 60 may be closed in the manner as discussed above.

Once the package in accordance with the present invention is assembled as discussed above, the cap 92 or the neck 70 may be rotated by the consumer to align various portions of an inner label to be viewable through the viewing window 23. As mentioned above, by providing a container package which allows for an interstitial area adjacent the viewing window 23 relative to the outer surface of the container 24, consumers will easily recognize that aspect of a rotatable system.

There are also other advantages of the present invention. In particular, the package 22 in accordance with the present invention also forms a package for the product. In the system disclosed in the '421 patent, the products with the rotatable label system are known to be generally disposed in additional packages which adds to the cost of the product.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A rotatable label system comprising:

a container having an opening and a first form factor including a round portion;

a cap adapted for closing the opening;

a label disposed on an outer surface of said round portion;

a housing configured with a second form factor and formed with a viewing window located in a flat portion of said second form factor; and said container housed within said housing so as to locate the label completely behind the plane of said flat portion so as to permit viewing of the label through the window so that an interstice is defined adjacent the window between the container and housing, said interstice being configured so as to enable a portion of the label not aligned with the window to be viewed from outside the housing, wherein said cap is exposed so as to permit access to the contents of the container by opening the cap and so as to enable the container to be rotated in the housing.

2. The rotatable label system as recited in claim 1, wherein said label is formed from a material other than said container.

3. The rotatable label system as recited in claim 1, wherein said label is formed on said container.

4. The rotatable label system as recited in claim 1, wherein said first form factor is generally circular.

5. The rotatable label system as recited in claim 4, wherein said second form factor is generally polygonal.

6. The rotatable label system as recited in claim 4, wherein said second form factor is generally not polygonal.

7. The rotatable label system as recited in claim 4, wherein said second form factor is irregularly shaped.

8. The rotatable label system as recited in claim 5, wherein said second form factor is generally square.

9. The rotatable label system as recited in claim 5, wherein said second form factor is generally rectangular.

10. The rotatable label system as recited in claim 1, wherein said first form factor is generally polygonal.

11. The rotatable label system as recited in claim 4, wherein said first form factor is generally not polygonal.

12. The rotatable label system as recited in claim 4, wherein said first form factor is irregularly shaped.

13. The rotatable label system as recited in claim 5, wherein said first form factor is generally square.

14. The rotatable label system as recited in claim 5, wherein said form factor is generally rectangular.

* * * * *

UNITED STATES PATENT AND TRADEMARK OFFICE

CERTIFICATE OF CORRECTION

PATENT NO. : 6,454,094 B1
DATED : September 24, 2002
INVENTOR(S) : Lawrence Aldo Salani It is certified that error appears in the above-identified patent and that said Letters Patent is hereby corrected as shown below:

Column 6,
Line 46, after "said" please insert -- first --.

Signed and Sealed this

Fourth Day of March, 2003

JAMES E. ROGAN
*Director of the United States Patent and Trademark Office*